US005230754A

United States Patent [19]

Setzer et al.

[11] Patent Number: 5,230,754

[45] Date of Patent: Jul. 27, 1993

[54] ALUMINUM MASTER ALLOYS CONTAINING STRONTIUM, BORON, AND SILICON FOR GRAIN REFINING AND MODIFYING ALUMINUM ALLOYS

[75] Inventors: William C. Setzer, Evansville, Ind.; David K. Young, Henderson; Bryan T. Dunville, Sebree, both of Ky.; Frank P. Koch, Evansville, Ind.; Richard J. Malliris, Henderson, Ky.

[73] Assignee: KB Alloys, Inc., Sinking Springs, Pa.

[21] Appl. No.: 664,309

[22] Filed: Mar. 4, 1991

[51] Int. Cl.[5] ..... C22C 21/00; C22C 21/02; C22C 1/02

[52] U.S. Cl. ..... 148/437; 420/528; 420/548; 420/549

[58] Field of Search ..... 148/437; 420/528, 548, 420/549

[56] References Cited

U.S. PATENT DOCUMENTS 3,567,429 3/1971 Dunkel et al. ..... 75/10.18
4,009,026 2/1977 Rasmêssen ..... 420/549
4,576,791 3/1986 Thistlethwaite ..... 420/552
5,045,110 9/1991 Vader et al. ..... 420/549

FOREIGN PATENT DOCUMENTS 398449 11/1990 European Pat. Off. .
0792172 3/1958 United Kingdom ..... 420/548

*Primary Examiner*—R. Dean
*Assistant Examiner*—Sikyin Ip
*Attorney, Agent, or Firm*—Dickstein, Shapiro & Morin

[57] ABSTRACT

Improved aluminum master alloys containing strontium and boron are provided for simultaneously modifying and grain refining Al alloys, and in particular, hypoeutectic Al-Si alloys. The improved master alloy contains, by weight percent, about 0.20-20% Sr, 0.10-10% B, and the balance Al with impurities. The master alloy may also contain about 0.20 to about 20% Si by weight percent. The master alloys have a high degree of ductility for purposes of forming continuously rolled master alloy rod stock.

13 Claims, 10 Drawing Sheets

ALUMINUM MASTER ALLOYS CONTAINING STRONTIUM, BORON, AND SILICON FOR GRAIN REFINING AND MODIFYING ALUMINUM ALLOYS

BACKGROUND OF THE INVENTION

This invention relates to an aluminum master alloys containing strontium and boron that are used to grain refine and modify the microstructure of Al alloys. More specifically, the invention relates to aluminum-strontium-boron ("Al-Sr-B") and aluminum-strontium-silicon-boron ("Al-Sr-Si-B") master alloys. The introduction of Sr and B into single master alloys provides products capable of accomplishing both grain refinement and morphological modification. Additionally, the combination of B and Sr results in enhanced ductility of the master alloys. The enhanced ductility eases processing of the master alloys into continuous rod products. This invention is especially useful in the grain refinement of hypoeutectic Al-Si alloys.

It is desirable amongst producers and manufacturers of Al alloys to grain refine and modify hypoeutectic Al-Si alloys in order to enhance the physical and mechanical properties thereof. In an unmodified hypoeutectic Al-Si alloy, the silicon-rich eutectic phase has a plate-like morphology such as that shown in FIGS. 1(*a*) and 1(*b*). This type of plate-like morphology has a negative affect on the physical and mechanical properties of the alloy. This deleterious affect may be minimized by modifying the structural morphology such that the eutectic phase forms fibers or particles as opposed to plates.

It is known in the art that Sr is an effective modifier for modifying the silicon-rich eutectic phase occurring in Al-Si alloys. See U.S. Pat. No. 4,108,646, U.S. Pat. No. 3,446,170, and K. Alker et al., "Experiences with the Permanent Modification of Al-Si Casting Alloys," *Aluminum*, 4B(S), 362–367 (1972), each of which is incorporated herein by reference. Typically, the silicon-rich eutectic phase in Al-Si alloys may be modified with an addition of 0.001 to 0.050 weight percent of Sr. Microstructurally, the addition of Sr modifies the microstructure of the eutectic phase thereby precluding formation of the lamellar or platelike structure typically encountered in unmodified alloys, as shown in by FIGS. 1(*a*) and 1(*b*). Microstructural modification is especially useful in hypoeutectic Al-Si alloys which enjoy broad commercial application.

Normally, Sr is introduced into the hypoeutectic Al-Si alloy through the addition of a Sr-containing master alloys, such as Al-Sr and Al-Sr-Si. From a practical standpoint, it is desirable that the master alloy contain a significant concentration of Sr in order to minimize the amount of master alloy added to the production alloy to accomplish effective modification. Thus, as the level of Sr increases in the master alloy, the amount of master alloy addition required to attain the desired residual level of Sr in the production alloy decreases, as does the time required to achieve Sr dissolution. Shorter dissolution time equates to shorter holding time in the furnace and reduced energy consumption per heat of finished production alloy. Additionally, shorter holding times lead to higher Sr recovery in the finished heat of production Al-Si alloy. Ultimately, higher Sr levels in the master alloy will result in increased operating efficiency and decreased processing costs for each heat of hypoeutectic alloy treated with such a master alloy. However, as discussed in greater detail below, the use of higher levels of Sr severely limits the degree of workability of the master alloy.

Besides structural modification, it is also desirable to grain refine Al alloys to preclude formation of columnar or twin columnar grains during solidification. It is known in the art that residual Ti, or other transition elements, on the order of 0.001 to 0.20 weight percent, assists in grain refining these alloys. See G. W. Boone et al., "Performance Characteristics of Metallurgical Grain Refiners in Hypoeutectic Al-Si Alloys," in *Production, Refining, Fabrication and Recycling of Light Metals*, 19:258-263 (1990); and G. K. Sigworth et al., "Grain Refining of Hypoeutectic Al-Si Alloys," *AFS Transactions*, 93:907–912 (1985), each of which is incorporated herein by reference. Nonetheless, even in the presence of residual Ti, casting conditions can occur whereby the resulting grain structure is too coarse. Thus, in certain instances it is necessary to introduce more effective additives, in addition to Ti, in order to achieve the desired degree of grain refinement.

It has been reported in the literature that an Al-B master alloy provides an excellent grain refining effect for aluminum alloys, so long as the B present in the master alloy is in the form of $AlB_2$, and not $AlB_{12}$, which forms above about 1700° F. See Sigworth et al., "Grain Refining of Hypoeutectic Al-Si Alloys," *AFS Transactions*, Vol. 93 (1985) p. 907–912, incorporated herein by reference There are significant problems associated with using a two step inoculation process, i.e., separate additions of B to grain refine and Sr to modify a bath of Al-Si hypoeutectic alloys. The introduction of B as an alloy of Al containing 4–5% B as $AlB_2$ or $AlB_{12}$ and B in solution is usually accompanied by sludging. Typically, the B master alloy is added to the bath while it is still in the furnace (as opposed to the ladle or tundish). Sludging occurs when borides combine with Ti and other transition elements to form intermetallic compounds such as $(Al, Ti, V)B_2$ which have a specific gravity greater than that of the still molten Al-Si alloy.

When the Sr and B are introduced separately into the bath, the inoculation process requires more time, which means the molten bath must be held in the furnace for a longer period. The result is that the boride particles tend to settle out, thereby forming a "sludge" in the lower or bottom portion of the bath. With infrequent stirring or cleaning, this sludge may tend to agglomerate. It results from long holding times in the furnace after the B addition has been made. This sludging effect can be offset by later additions or by stirring or agitating the bath thereby minimizing agglomeration of boride DKY, WOS, BTD, RDM particles. Nonetheless, a single step inoculation process could eliminate the need for agitation by reducing the holding time of the inoculated hypoeutectic Al-Si bath in the case where modification occurs rapidly following the addition of Sr.

Generally speaking, modifiers and grain refiners are produced in a variety of forms with each form specifically suited for a particular type of finished alloy melting process. Thus, conventional master alloys are available in the form of waffle, ingot, powder, rod, wire, loose chunk, and the like.

In many operations, special feed drive mechanisms have been developed to feed a continuous strand or rod of the master alloy into a molten bath of the alloy being treated. Typically, the continuous rod product is produced in various diameters, including, without limitation, ⅜" rod. The rod is wound about a carrier spool which is mounted directly on or in the vicinity of the feed drive mechanism which feeds the rod-shaped additive into the molten bath. Rod products are produced by rolling, drawing, or extruding bar stock having the desired master alloy composition.

A major advantage to using rod-type products for inoculation of Al-Si hypoeutectic alloys is the elimination of process steps, i.e., weighing the master alloy prior to adding it to the bath. Instead, the rod feeder automatically adds the required length of rod per unit time.

In the case where a short incubation time suffices, an additional benefit of the rod feeder is that it allows a more efficient addition to be made because the master alloy can be added outside the holding or melting furnace. For instance, the inoculation can be made in the tapping trough which transports the molten Al-Si alloy from the furnace to the casting station. The inoculation can then be conducted at lower temperatures, and in less time than would be required for furnace inoculation. The end result is higher recovery of B and Sr in the treated alloy and thus more effective grain refinement and modification in the case where a short incubation time allows this approach to be followed.

As stated earlier, because less volume of master alloy is required, it is desirable to have a master alloy containing a high concentration of Sr, preferably in excess of five weight percent Sr. However, higher levels of Sr severely limits the degree of workability of the master alloy for purposes of producing a rod-type product, so much so that the alloy cannot be successfully continuously rolled.

Specifically, when the Sr content exceeds the solid solubility limit of Sr in Al, an extremely hard, brittle, and semi-continuous intermetallic compound is formed. The intermetallic compound is $SrAl_4$, which is usually detrimental in master alloys containing Sr in excess of five weight percent. The coarse $SrAl_4$ that is formed severely limits the ductility, and hence workability, of the master alloy, thereby dictating the final form of the master alloy and the methods by which the master alloy may be manufactured. Consequently, master alloys containing about ten percent Sr up to now have experienced considerable difficulty during continuous rolling, i.e., breakage due to tensile fracture.

Thus, in order to successfully produce a usable, highly alloyed Al-Sr rod product, manufacturers are confined to extruding techniques, which typically do not produce tensile stresses, during fabrication, in order to produce an acceptable rod product. These manufacturing processes, by their nature, are less cost-effective than continuous casting and rolling.

There are a number of practical limitations associated with the extrusion process which results in higher processing costs to the manufacturer and to the end user. Typically, the extrusion process commences by casting a billet of the master alloy, which is then cut to length and placed into the extrusion press whereupon it is subject to hydrostatic compressive loading. The extrusive process forces the bar stock through a die cavity having the diameter of the resultant rod product. As the rod comes out of the extrusion die, it must be wound and packaged onto spools for subsequent use in mechanically driven feeders. Often times, several billets may be required to complete a single spool of rod product. That means that at the end of each billet, the operator must interrupt the extrusion process to remove residual fragments of the remaining billet and insert a new billet in order to add rod to the spool. This interruption in the extrusion process leads to several extrusion defects, including a very rough surface along the initial length of rod until the rod attains critical speed as it exits the die. Preferably this is discarded.

Upon restarting the press with a fresh billet, it may take up to twenty feet or more of initial rod stock through the die in order to attain the critical speed which produces a smooth surface. The rough surface defect is apparent and readily visible to the end user. This defect causes the rod to be brittle and, if excessive, may cause the end user's feed drive mechanism to malfunction due to slippage of the rod product during furnace additions. This sort of malfunction will directly result in a reduced Sr level, below the calculated value, in the finished cast product and may lead to insufficient modification and consequently defective or scrap material.

Additionally, the use of static or semi-continuous casting techniques to form the initial master alloy billet often times introduces excessive oxide particles into the structure of the melt. These particles become entrained in the billet during solidification. Since Sr is a more active oxidizing agent than is Al, a significant portion of the oxide particles formed during casting will be Sr-oxide. It is believed that Sr-oxide does not contribute to the modification of the Al-Si eutectic phase even though the Sr associated therewith is still quantitatively present in the master alloy. Thus, once Sr-oxide is formed in the master alloy, it will not contribute to modification of the treated Al-Sr alloy. Also, the presence of Sr-oxide in the master alloy will result in artificially high recovery levels of Sr. The Sr-oxide effectively precludes or blocks availability of a portion of the Sr being added to the Al-Si alloy from modifying the eutectic phase. Moreover, once these Sr-oxide particles have been introduced into the Al-Si alloy during inoculation, they will be carried into the final product, which can result in reduced fracture toughness, lower tensile strength, and reduced fatigue resistance in the finished product.

Another defect common to extrusion processing is a blister defect which results from non-parallel billet cuts, cold laps, or undersized billets. The blisters result when air is entrapped between the extrusion press housing and the outer surface of the billet.

These types of defects are not present to the same degree on continuously cast and rolled rod stock. Therefore, it would be very advantageous to produce a highly alloyed Sr master alloy which can be continuously cast and rolled.

Thus, there is a significant need for a cost-effective, continuously cast and rolled or conventional form combination master alloy containing about ten percent Sr to provide effective microstructural modification in hypoeutectic Al-Si alloys, along with a second agent that effectively grain refines the treated alloy while further contributing high ductility to the master alloy. These characteristics enhance the processing of the master alloy into a rod product, thereby eliminating the defects commonly encountered in conventionally processed Al-10%Sr master alloy rod products.

SUMMARY OF THE INVENTION

It is an object of the invention to provide an improved combination modifier-grain refiner for Al alloys that may be introduced in to Al casting alloys to produce more desirable microstructural morphologies and final products having fine grain structure.

Another object of the present invention is to provide improved Al-Sr-B and Al-Sr-Si-B master alloys for purposes of achieving both grain refinement and modification of the hypoeutectic Al-Si alloy casting structure.

Another object of the present invention is to provide Al-Sr-B and Al-Sr-Si-B master alloys containing up to about twenty percent Sr.

It is yet another object of the invention to provide a highly alloyed master alloy having a high degree of ductility for purposes of forming continuously rolled master alloy rod stock.

It is a further object of the present invention to provide a master alloy that is a combination modifier and grain refiner for Al casting alloys which results in reduced manufacturing costs for both the master alloy and the resulting Al alloy to which the master alloy is added.

It is another object of the present invention to provide Al-Sr-B and Al-Sr-Si-B master alloys capable of yielding continuously rolled rod stock having superior surface quality and compositional uniformity.

Additional objects and advantages of the invention will be set forth in the detailed description that follows, and in part will be obvious from the description, or maybe learned by practice of the invention. The objects and advantages of the invention will be attained by means of the instrumentalities and combinations particularly pointed out in the appended claims.

To achieve the objects and in accordance with the purpose of the invention, as embodied and broadly described herein, the present invention provides for an Al-Sr-B master alloy containing, in weight percent, about 0.20% to 20% Sr, 0.10% to 10% B, and the balance Al plus other impurities normally found in master alloys and further provide for an Al-Sr-Si-B master alloy containing, in weight percent, about 0.20% to 20% Sr, 0.20% to 20% Si, 0.10% to 10% B, and the balance Al plus other impurities normally found in master alloys. A preferred embodiment of the invention contains about 5–15% Sr and about 2–8% B. The optimum ratio, by weight, of Sr:B is in excess of 1.35:1, which will ensure sufficient Sr to preclude the B in the master alloy not being associated with Sr as an intermetallic phase.

The accompanying figures, which are incorporated in and constitute a part of this specification, together with the description, serve to explain the principles of the invention.

BRIEF DESCRIPTION OF DRAWINGS

FIGS. 1(*a*) and 1(*b*) shows Class 1 unmodified structure;

FIGS. 1(*c*) and 1(*d*) shows Class 2 partially modified lamellar structure;

FIGS. 1(*e*) and 1(*f*) shows Class 3 partially modified structure;

FIGS. 1(*g*) and 1(*h*) shows Class 4 modified structure without lamellae;

FIGS. 1(*i*) and 1(*j*) shows Class 5 modified fibrous structure; and

FIGS. 1(*k*) and 1(*l*) shows Class 6 very fine modified structure.

DETAILED DESCRIPTION OF THE INVENTION

Figure 1B:
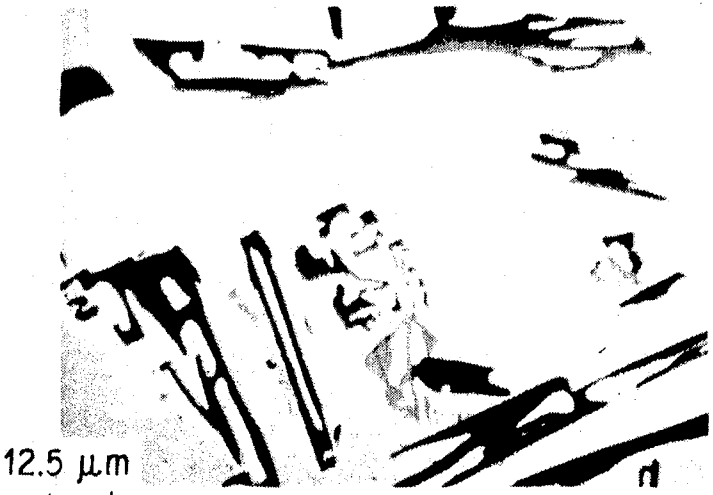
FIGS. 1(*a*)–1(*l*) are photomicrographs of hypoeutectic Al-Si alloys showing the various classes of eutectic phase morphology.
Figure 1A:
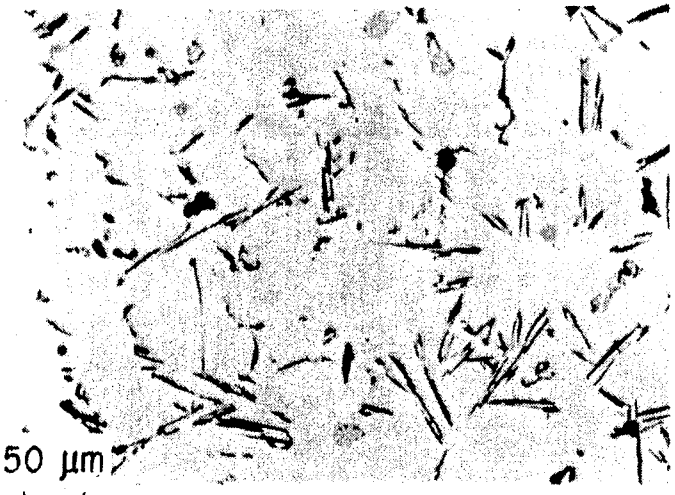
Figure 1D:
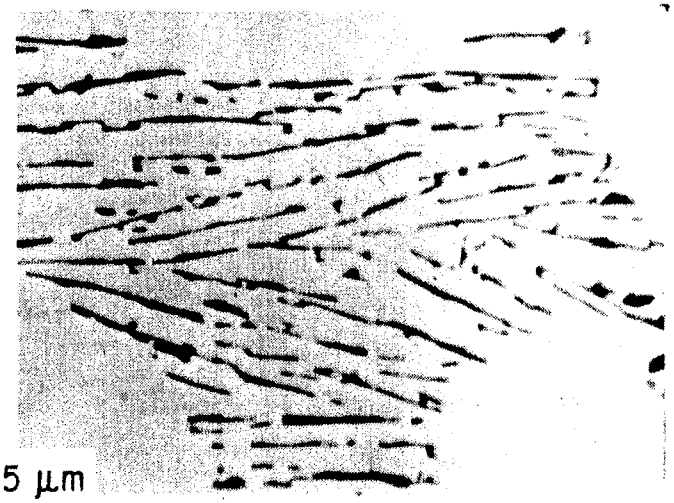
Figure 1C:
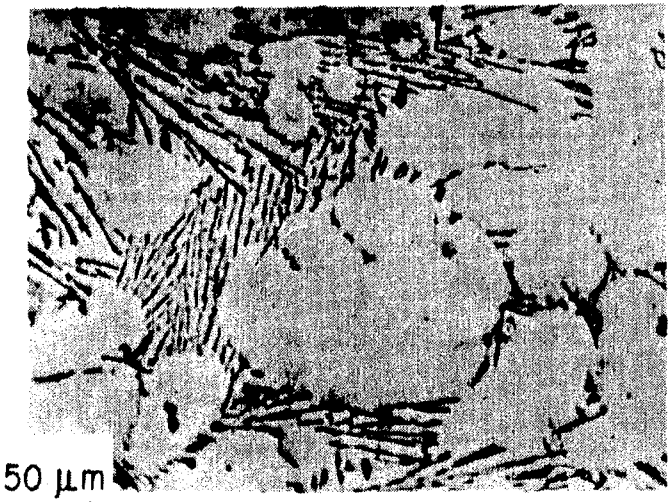
Figure 1F:
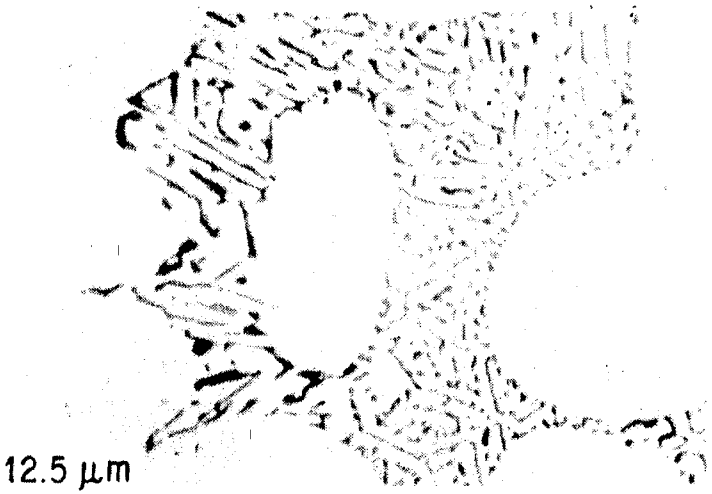
Figure 1E:
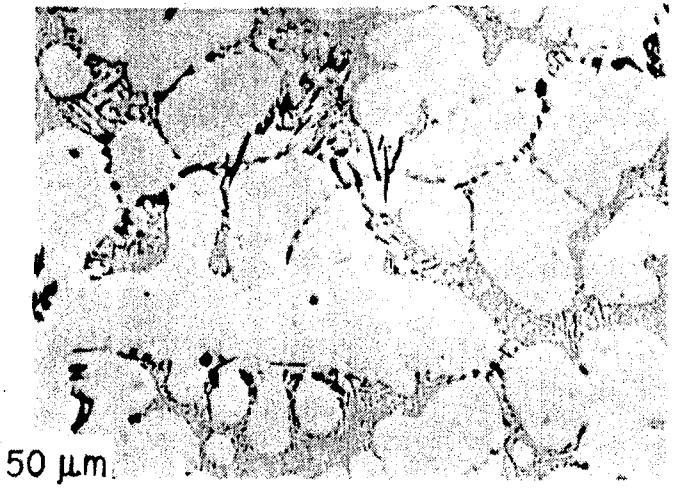
Figure 1H:
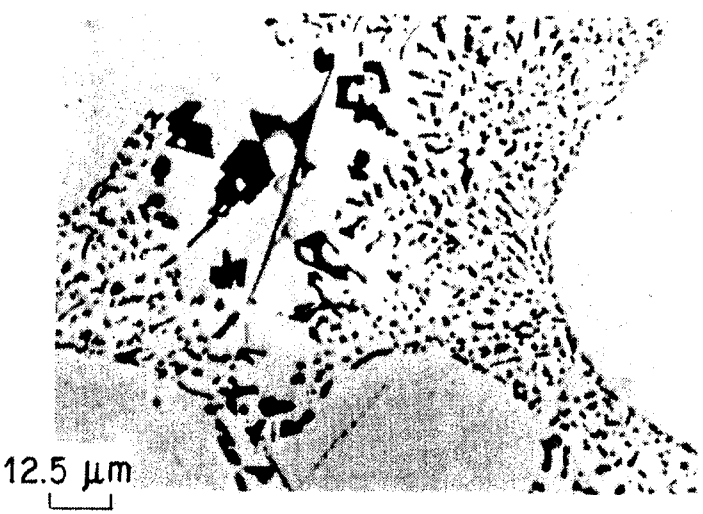
Figure 1G:
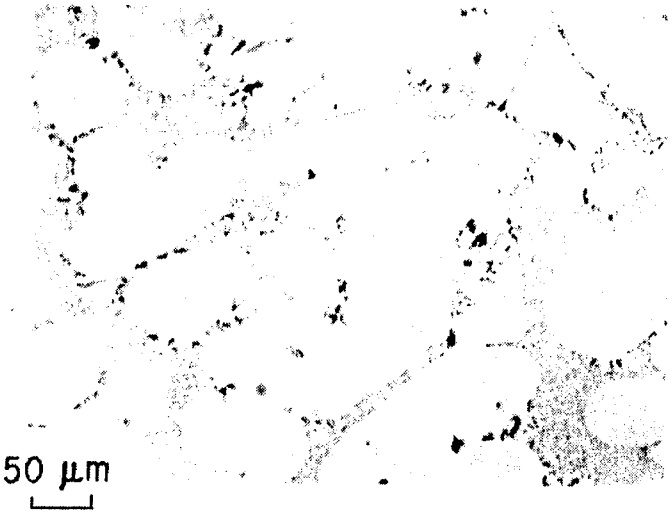
Figure 1J:
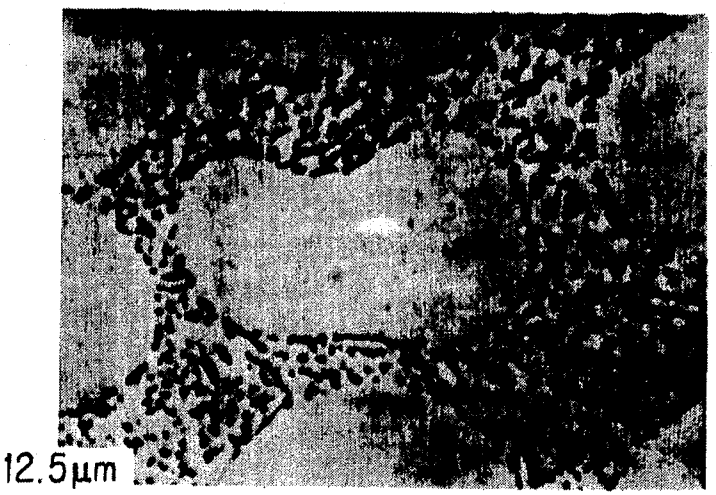
Figure 1I:
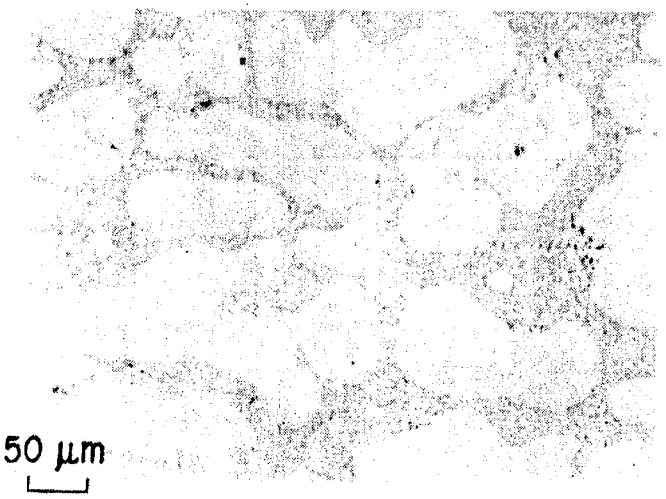
Figure 1L:
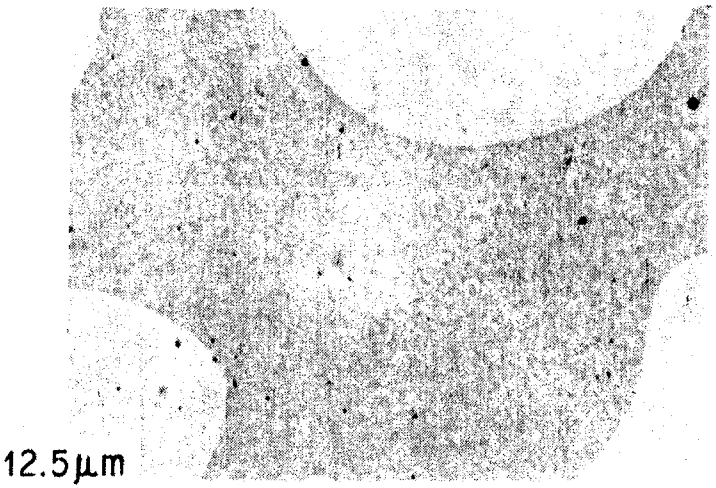
Figure 1K:
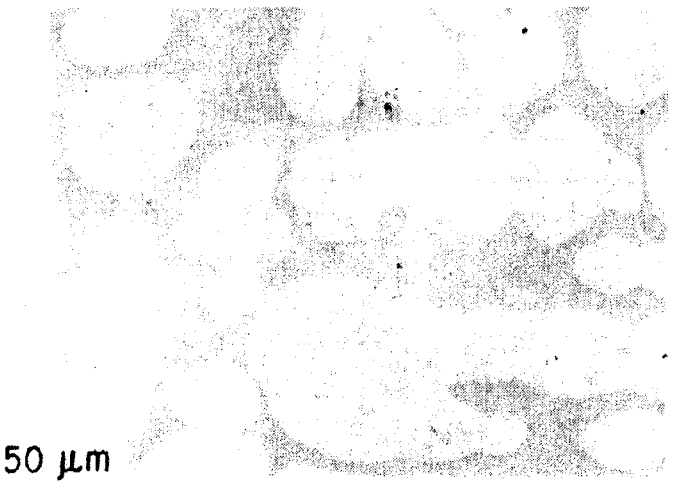

Reference will now be made in detail to the preferred embodiment of the invention, which, together with the following examples, serve to explain the principles of the invention.

The present invention relates to an Al-based master alloy containing in weight percent about 0.20–20.0% Sr and about 0.1–10.0% B, with the balance being Al or Al-Si plus the usual impurities commonly encountered in similar type master alloys. Where the balance is Al-Si, the weight percent of Si is about 0.20–20.0%. The ratio of Sr to B is in the range of about 1.35–10 to 1, preferably about 2–4:1, and most preferably about 2:1. Preferably, the master alloy contains about 5%–15% Sr and about 2%–8% B, with the balance being Al or Al-Si plus impurities. Where the balance is Al-Si and the master alloy contains 5–15 weight percent Sr and 2–8 weight percent B, it preferably contains about 5–15 weight percent Si. The master alloys of the present invention are used primarily as a structural modifier and grain refiner for Al-Si alloys, and more specifically, for hypoeutectic Al-Si alloys.

In the preferred embodiment, the master alloy has a Sr level of about 5–15% and a B level of about 2–8%. The weight ratio of Sr:B in the preferred embodiment is therefore about 2–4:1. The main criteria for determining the Sr:B ratio is the amount of Sr to be added to the Al-Si alloy, which is typically about 0.005–0.02%. As the Sr:B ratio approaches the lower values of 1.35:1, B in excess of that needed to adequately grain refine is being added to the Al-Si alloy. However, the extra B does not further enhance grain refinement. Thus, in most instances, it is desirable to have an excess of Sr by having higher values of Sr:B, rather than lower values. Furthermore, as stated earlier herein, it is possible to continuously roll an Al-Sr master alloy containing about 3–5% Sr. Thus, not all of the Sr in a high alloy Sr-B master alloy need be tied up as $SrB_6$. Depending on the grain refining need and the modification need, the Sr:B ratio can effectively vary from a high of 10:1 to a low of 1.35:1 with the preference for values in the range of 2–4:1 without deviating from the operation or intent of the invention.

In certain situations, it may be desirable to have excess Sr (Sr:B > 1.35:1) either in solid solution or perhaps as $SrAl_x$, but not to the extent that it would be detrimental to continuous rolling processes of material ductility or exceed the amount of B required to grain refine or aggravate sludging. When Sr is added to a molten bath of Al-B, the B combines with Sr to form $SrB_6$, thereby minimizing formation of $SrAl_4$.

A computer enhanced image was generated to determine the approximate volume or area fracture that $SrAl_4$ or $SrB_6$ occupies. The particles or features were identified according to their gray scale. Parameters, such as area fraction of the particles and elongation factor (ratio of average length to average width of the particles), were calculated. The area fraction of the $SrAl_4$ phase in 10% Sr rod was approximately 20%. An addition of 4% B decreased the intermetallic area fraction, consisting of $SrAl_4$ and $SrB_6$/ $Sr_xAl_yB_z$, to about 12%.

Thus, $SrB_6$ occupies a smaller volume fraction of the microstructure. This allows a highly alloyed, 15–20% Sr plus B, to be produced. The elongation factor for the $SrAl_4$ phase was 3.6, while that of the $SrB_6$ was 1.3. Therefore, from a morphological perspective, the $SrAl_4$ particles are shaped as long platelets and the $SrB_6$ occurs as cubical particles. As cubic particles, $SrB_6$ provides no easy path for crack propagation, unlike the extensive plate network associated with $SrAl_4$.

Figure 2:
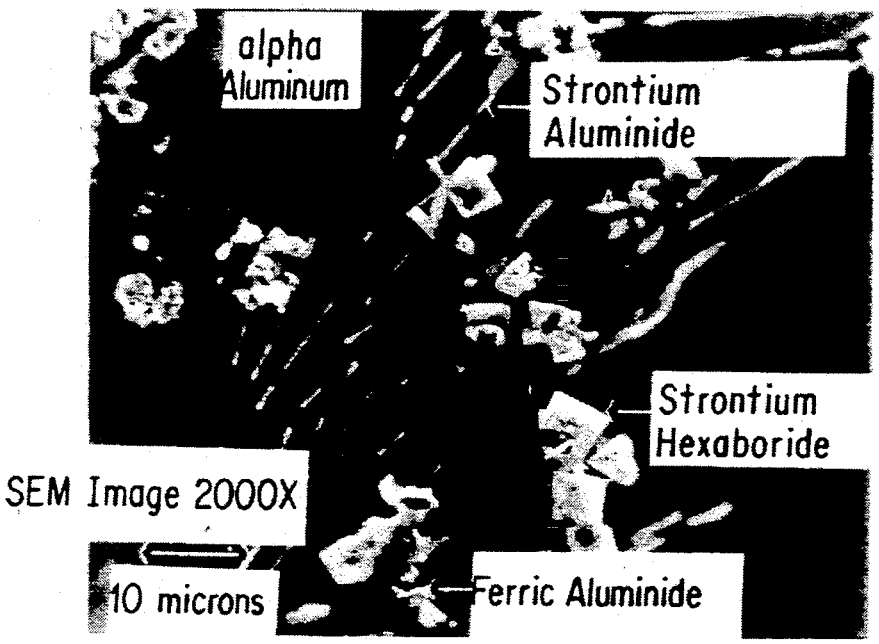
FIG. 2 is a photomicrograph showing morphological characteristics of $SrB_6$ and $SrAl_4$.

FIG. 2 illustrates the morphological characteristics of $SrB_6$ and $SrA1_4$. The $SrB_6$ enhances the ductility of the master alloy, thus facilitating production of rod products. When the master alloy is added to a heat of Al-Si alloy, thermodynamics indicate that the B dissociates from Sr. This allows the Sr to modify the eutectic phase and the B to grain refine by combining with the residual Ti or other transition elements contained in the melt of the hypoeutectic Al-Si alloy being treated.

A method for making the Al-Sr-B master alloy comprises melting a heat of relatively pure Al, typically commercial purity. The temperature of the molten bath is elevated to about 1220° to 1500° F. A sufficient amount of B is added to the molten Al in order to arrive at the desired composition of B in the master alloy. A sufficient amount of Sr is then introduced into the molten Al-B and allowed to mix thoroughly, thereby forming the master alloy. The Sr combines with B to form the intermetallic phases, $SrB_6$ or $Sr_xAl_yB_z$ (incomplete reaction). Thereafter the master alloy is cast into a form suitable for further processing. Alternative methods for producing the master alloy can be used, such as adding $SrB_6$ or $Sr_xAl_yB_z$ to an Al or Al-Sr melt.

The Al-Sr-Si-B master alloy of the invention is prepared in a similar manner. After the B is added to the molten Al, a sufficient amount of Sr and Si is added to the molten bath to arrive at the final desired concentration of both of these elements in the master alloy. The elements are mixed thoroughly and the master alloy is cast into a form suitable for further processing. Generally the Sr and Si are already in an alloy when added at a 1:1 to 1.5 to 1 ratio. Alternative methods for producing this master alloy include adding $SrB_6$ +Si or $Sr_xAl_yB_z$+Si to a molten bath of Al, Al-Sr, or Al-Sr-Si.

During manufacture, the B is in the molten bath in the form of $AlB_2$ or $AlB_{12}$. Subsequently, Sr is introduced, whereupon $AlB_2$ and $AlB_{12}$ readily dissociate in the presence of Sr to form $SrB_6$. $SrB_6$ precludes formation of the extremely brittle phase $SrAl_4$. The master alloy retains excellent ductility by minimizing the presence of $SrAl_4$, thereby permitting continuous rolling into rod stock. The master alloy, because of its enhanced ductility, may be produced in a variety of forms including wire and rod, as well as waffle, shot or some other conventional form.

The present invention accomplishes dual objectives upon addition to a melt of hypoeutectic Al-Si alloy. First, the microstructure is modified, and second, the resultant microstructure is grain refined. The combination of the two elements, Sr and B, in a single master alloy, and the interaction of the B with the residual transition elements, enables the end user to accomplish these two metallurgical processing steps with à single step inoculation.

In the absence of grain refiners, the Al-Si hypoeutectic alloy typically is characterized by large, coarse grains. This type of grain structure may have a deleterious effect on the physical and mechanical properties of the end product. These properties are further effected by the morphology of the silicon-rich eutectic phase which, when unmodified, is typically present in the form of large acicular plates as illustrated in FIGS. 1(*a*) and 1(*b*). Modification of the eutectic phase results from the introduction of Sr present in the master alloy. FIGS. 1(*c*)–1(*l*) illustrate the extent to which the eutectic phase may be modified. For example, Class 1 structures are essentially unmodified, FIGS. 1(*a*) and 1(*b*), Class 4 structure constitutes a modified structure without lamellae, FIGS. 1(*g*) and 1(*h*), and Class 6 corresponds to a fully modified structure, FIGS. 1(*k*) and 1(*l*).

Figure 5:
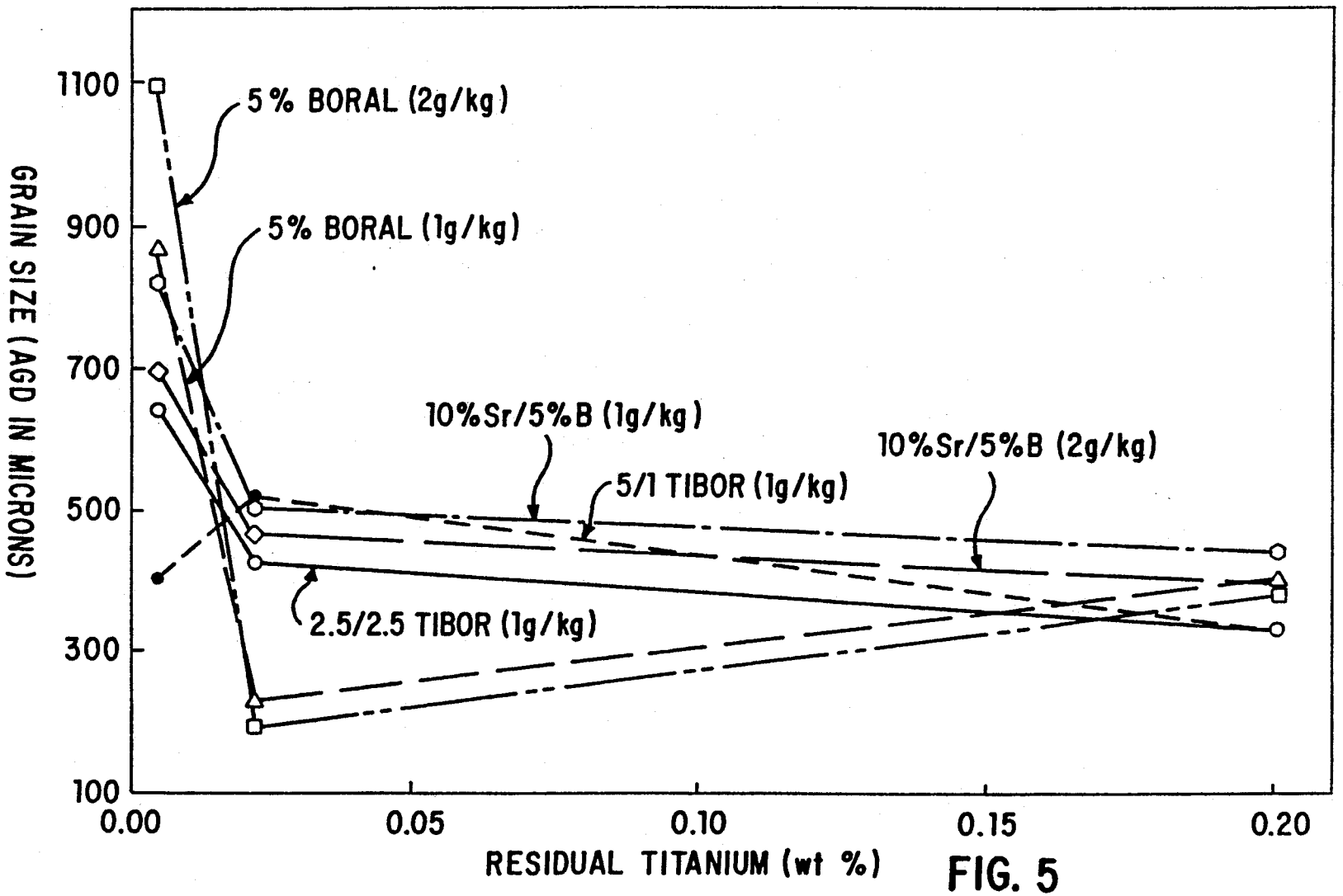
FIG. 5 is a diagram showing grain refinement of an A356 alloy as a function of residual Ti for different grain refining alloys including a combination Sr-B master alloy.

Grain refinement results directly from the presence of B in the master alloy and is enhanced by the presence of residual transition elements in the Al-Si alloy. When added to the Al-Si alloy, B combines with residual Ti contained in the Al-Si alloy to form particles of $TiB_2$ which enhance nucleation. In order for the Sr-B master alloy to function properly when added to the Al-Si alloy, it is beneficial if the Al-Si alloy contains a residual amount of transition elements, such as Ti, V or Hf. The most commonly used transition element is Ti which is present in the range of 0.001%–0.25% in commercial alloys. As between Ti, Sr, or Al, B will preferentially combine with Ti. Thus, the $SrB_6$ dissociates, freeing up Sr and thereby permitting modification of the alloy, the B must combine with the residual Ti contained in the Al-Si alloy. Thereafter, the Sr is available to modify the silicon-rich eutectic phase. Under normal circumstances, Al-Si alloys will usually contain Ti on the order of 0.01–0.10% from previous processing or manufacturing because residual Ti enhances grain refining, and Al-Si alloys in general are rather difficult to grain refine. Even in the absence of measurable levels of residual Ti, or other transition elements, the combination master alloy satisfactorily modifies and grain refines hypoeutectic Al-Si alloys. Thus, the role that residual Ti plays is secondary in facilitating the dual modification and grain refinement accomplished by the master alloy of the invention. See FIGS. 3 and 5 and Tables II and III.

The presence of B in the master alloy not only provides for grain refinement, but it also permits attainment of higher Sr concentrations in the master alloy. It is the interaction between B and Sr which permits Sr levels up to about 20% without the same decrease in ductility as is commonly encountered in other master alloys containing in excess of 3–5% Sr without B. The Sr, when introduced into the master alloy, interacts with the B to form $SrB_6$ such that little if any of the Sr remains unassociated to combine with Al to form the embrittling phase $SrAl_4$. Reduced amounts of $SrAl_4$ result in improved ductility.

Consequently, the master alloys of the present invention are capable of being rolled, drawn, swaged, or extruded to form high quality rod stock which may be used as feed stock for mechanical feeders used to treat large heats of Al-Si alloy. The resulting rod product has a uniform composition profile through the rod cross-section and along the length of the rod, such that the product may be added to the Al-Si alloy at a constant and continuous rate to achieve the desired addition of Sr and B. This compositional uniformity eliminates the need for weight scales to measure out precise weights of master alloy. For automatic feed machines having constant feed rates, the operator need only set the machine operating parameters to ensure delivery of the desired length of rod stock per unit time and hence the desired amount of Sr and B into the Al-Si alloy.

There are several additional advantages to the master alloys of the invention. The fact that they are able to contain a much higher concentration of Sr than conventional alloys lowers the unit cost of each Sr addition to casting alloys. Moreover, the combination of a modifying agent and a grain refining agent in one alloy minimizes the handling and overall costs relating to the addition of master alloys to casting alloys. Finally, the master alloys permit the use of a superior grain refiner (boron) without detracting from modification. In fact, this appears to reduce the incubation time for grain refining and modification.

The Al-Sr-B or Al-Sr-Si-B master alloy of the invention can be produced in other forms, such as waffle, ingot, or other conventionally used or newly developed forms. The Sr-B master alloy in these forms will also perform equivalent to that of a rod product by producing rapid modification and grain refining.

It is to be understood that the application of the teachings of the present invention to a specific problem or environment will be within the capabilities of one having ordinary skill in the art in light of the teachings contained herein. Examples of the products of the present invention and processes for their use appear in the following example.

EXAMPLE

Treating Al-Si-Alloys with 2/1 SR-B Master Alloy

The method previously described herein was used to produce a master alloy having 8.9% Sr, 4.5% B, 0.11% Si, 0.13% Fe and balance Al. (Si and Fe are residual elements typically encountered in master alloys.)

Tests were performed on samples of A356 and 319 Al-Si alloys, each with varying amounts of residual Ti. The desired Ti residual was achieved by adding 6% TITAL ® master alloy rod to the bath of A356 or 319, respectively, and holding it for 30 minutes at 1400° F. Grain refining and modification tests were performed on rod and waffle products: 5/1 TIBOR ® master alloy rod, 8.9/4.5 Sr-B waffle, 5% BORAL ® master alloy ($AlB_2$) waffle, and 2.5/2.5 TIBOR ® master alloy waffle. The chemical composition of all products can be found in Table I.

TABLE I

| ALLOY | Chemical Composition of Alloys (Wt. %) | | | | | | | | |
|---|---|---|---|---|---|---|---|---|---|
| | Si | Fe | Cu | Zn | Mg | Mn | B | Ti | Sr |
| A356 | 6.6 | 0.15 | — | 0.01 | 0.38 | — | — | 0.005 | — |
| 319 | 6.0 | 0.67 | 3.19 | 0.76 | 0.09 | 0.29 | — | 0.005 | — |
| 5/1 TIBOR ® | 0.09 | 0.11 | — | — | — | — | 1.0 | 5.1 | — |
| 5% BORAL ® | 0.17 | 0.12 | — | — | — | — | 5.2 | — | — |
| 2.5/2.5 TIBOR ® | 0.10 | 0.17 | — | — | — | — | 2.7 | 2.6 | — |

TABLE I-continued

| ALLOY | Chemical Composition of Alloys (Wt. %) | | | | | | | | |
|---|---|---|---|---|---|---|---|---|---|
| | Si | Fe | Cu | Zn | Mg | Mn | B | Ti | Sr |
| 2/1 Sr—B | 0.11 | 0.13 | — | — | — | — | * | — | 8.9 |

*Analysis bias due to elemental interaction.
Calculated value - 4.5% boron.

Experiments were performed using the KB Alloys (KBA) Calibrated Ring Test (QCI 3.2.1, Jul. 15, 1990), Aluminum Association Standard Test Procedure for Aluminum Alloy Grain Refiners (TP-1, 1990), and the Reynolds Metal Company Golf Tee Test as specified in "Aluminum Grain Refiners and Alloy Modification Agents," (QA-2, Jan. 31, 1990). Thin sections of the waffle grain refining products were cut and added to a 5000–8000 gram melt. In the case of rod, full sections were cut. The grain refiner addition rates on all products were 1 kg/1000 kg with additional tests performed using 2 kg/1000 kg for the 5% BORAL and 2/1 Sr-B. All tests were performed using material from the same master alloy heats.

The grain refiner addition was made to A356 or 319 with an initial 15 second stir. Grain refining and modification samples were taken at 1, 3, 5, 15, 30, and 32 minutes. The melt was stirred for 15 seconds immediately before each sample was taken, except for the 15 and 30 minute samples where no stirring was performed before sampling. Spectrochemical samples were taken at 15, 30, and 32 minutes to determine composition.

Sample Preparation for Evaluation of grain Refinement and Modification

After casting, the KBA Calibrated Ring Test samples were mechanically polished using 4000 grit Si carbide paper and macroetched in Poulton's solution. The 319 samples were desmutted in a dilute nitric acid solution. The average grain diameter (AGD) was then determined by comparing the samples to standards of 50 micron increments. All other samples were cut and mechanically polished to a 0.04 micron particle size abrasive. Aluminum Association and Reynolds Golf Tee samples were then anodized using a 5–6% HBF solution. The average intercept (AID) distance was determined under polarized light at a magnification of 50X using the ASTM E-112 procedure. To reduce the variance in the results due to oxidation of the sample surface, the anodized samples were counted by two observers immediately after preparation. The average of their numbers are reported.

Grain Refining Results

Figure 3:
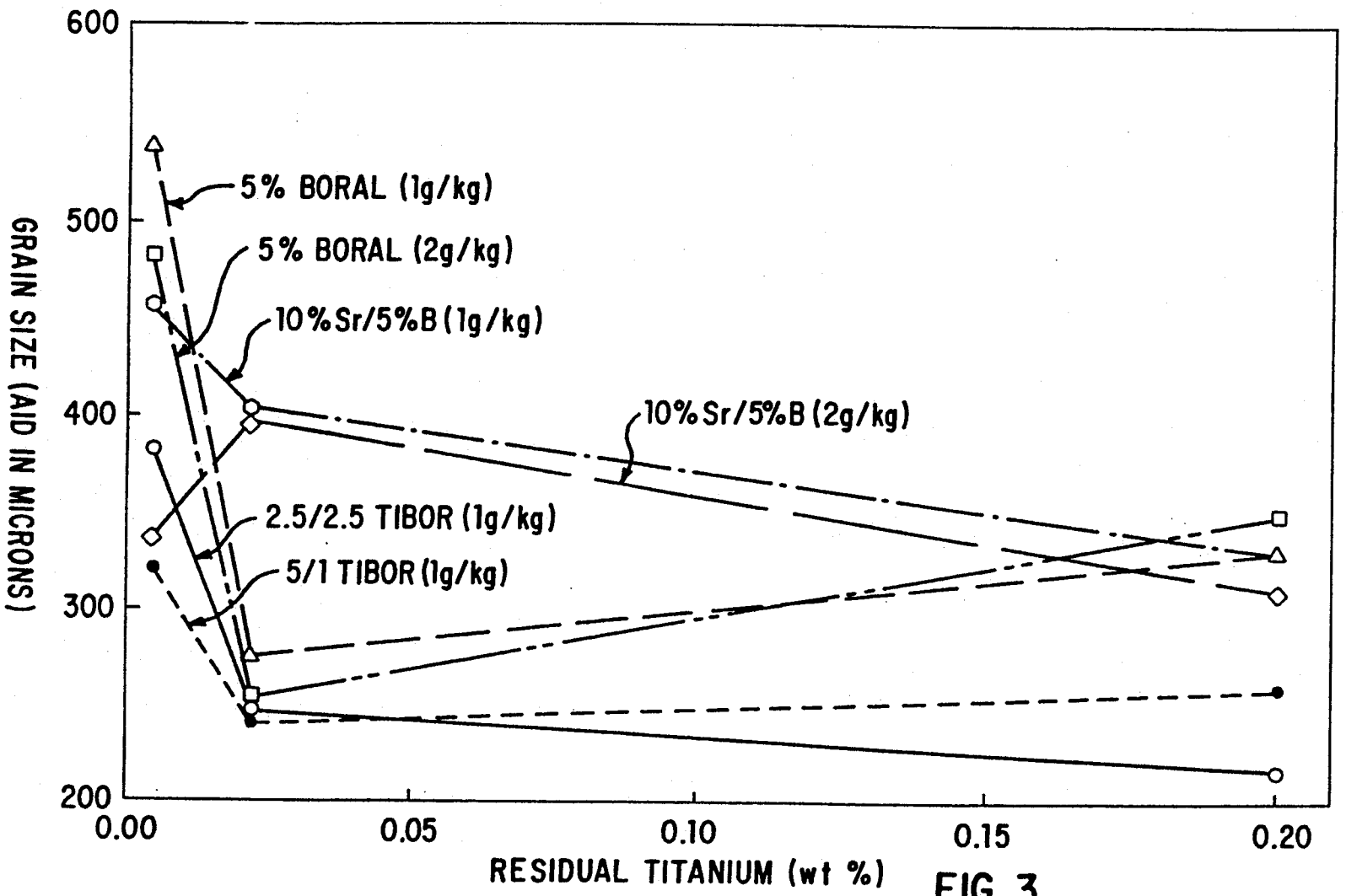
FIG. 3 is a diagram showing grain refinement of a 319 alloy as a function of residual Ti for different grain refiner alloys including a combination Sr-B master alloy.
Figure 4:
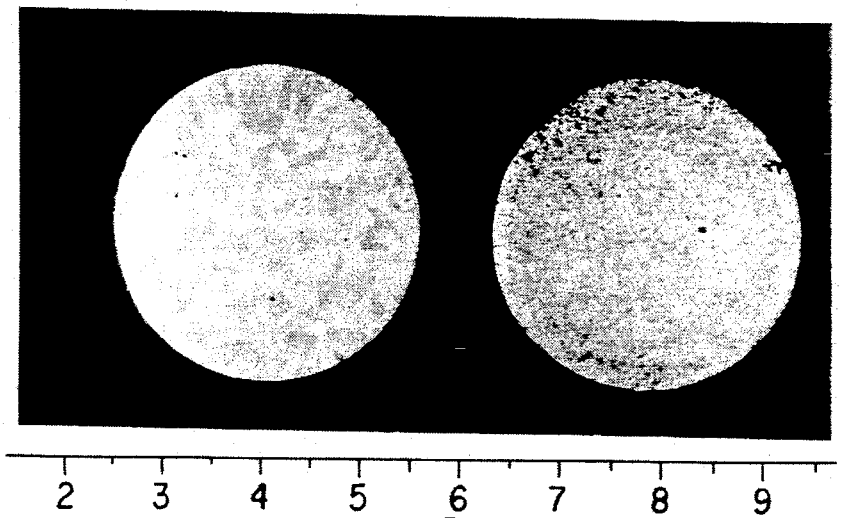
FIG. 4 is a photomicrograph of an ungrain refined sample of 319 alloy (left) containing 0.005% residual Ti and a grain refined 319 alloy (right) using a 8.9% Sr and 4.5% B master alloy at 0.02% Sr addition.
Figure 6:
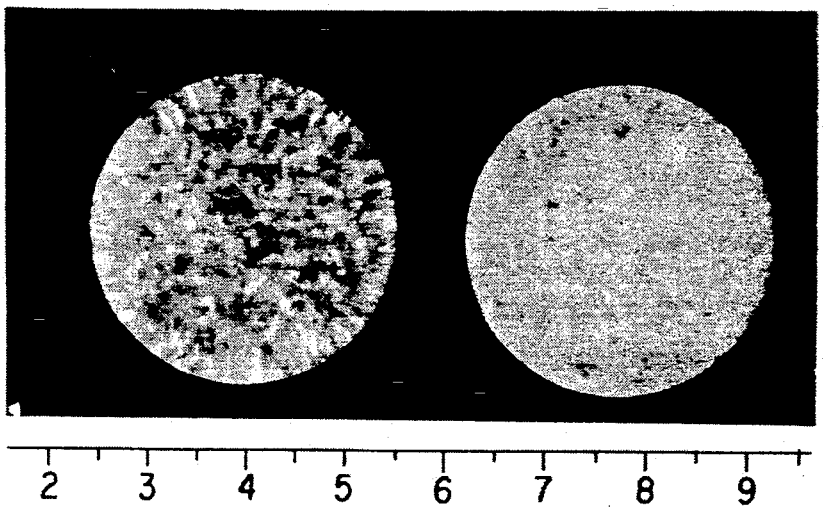
FIG. 6 is a photomicrograph of an ungrain refined sample of A356 alloy (left) containing 0.005% residual Ti and a grain refined A356 alloy (right) using a 8.9% Sr and 4.5% B master alloy at 0.02% Sr addition.

Using the above described procedure, the Sr-B master alloy was added to several heats of molten 319 alloy, having different amounts of residual Ti. FIG. 3 shows the grain size as a function of residual Ti concentration. Accordingly, at 0.022% Ti residual, the resulting grain size for the Sr-B alloy addition was less than or equal to 400 microns. FIG. 4 shows a photomicrograph of a sample taken from the same 319 heat after grain refining with the 8.9/4.5 Sr-B master alloy.

The same master alloy was used to grain refine heats of A356 alloy, having different amounts of residual Ti. The results of these tests ar shown in FIG. 5. A residual Ti of 0.20% yielded a grain size of approximately 300 microns AID using the Aluminum Association Test Procedure when a 2g/kg addition was made.

Modification Results

Tables II and III contain the modification results for both A356 and 319. Reference can be made to FIGS 1(*a*)–1(*l*) to determine the extent of modification. Sr additions of the Sr-B alloy were made at both 0.01% and 0.02% Sr levels. At one minute after the 0.01% Sr addition, the 319 alloy was partially modified (Class 3). By three minutes, modification was complete, resulting in a Class 4 rating except for the low Ti residual level where the alloy was still only partially modified. By five minutes, the 319 alloy was uniformly modified and the level of residual Ti or degree of agitation had no further effect on the resulting modification class. At 0.02% Sr, Class 4 modification was achieved within 1 minute. These results were achieved at 1300° F., which is normally considered a temperature where modification is delayed.

A356 characteristically is more difficult to modify; using the Sr-B master alloy of the present invention, partial modification was complete by one minute, except for the 0.005% Ti residual alloy, which still contained some lamellar eutectic structure. By three minutes, all samples were Class 3 modified. The 0.02% Sr addition to A356 produced Class 4 modification within one minute regardless of Ti residual. No loss in modification was noted at 15 and 30 minutes when stirring wa discontinued after five minutes.

Modification tests run at 1400° F. with an 0.02% Sr addition produced the same results as 1300° F. tests. It was expected, since modification is temperature sensitive, that a hold time would be necessary for Class 4 modification to be achieved. However, this was not the case. Class 4 modification was quickly achieved even at 1300° F. It was expected that at high Ti residuals both the 319 and A356 alloys would be modified, since the Ti residual and Al would react with the $SrB_6$ phase to produce $TiB_2$ and $SrAl_4$, which would now allow the Sr to be active. However, at optimum Ti residuals, theoretically, about 40% of the Sr remains $SrB_6$. In spite of this, the residual Ti was observed to have little effect on the modification achieved.

The 319 alloy, having from 0.005–0.2% residual Ti, yielded a class 4 modified structure after only 1 minute holding time given a Sr addition of 0.02%. Similarly, an A356 alloy containing 0.005–0.2% Ti achieved a class 4 modified structure after 1 minute holding time with a Sr addition of 0.02%.

TABLE II

Modification Rating (Class) of A356 With 0.01% and 0.02% Sr Addition

| Time | 0.005% Ti .01% | | 0.022% Ti | | 0.2% Ti | |
|---|---|---|---|---|---|---|
| Min. | Sr | .02% Sr | .01% Sr | .02% Sr | .01% Sr | .02% Sr |
| 1 | 2 | 4 | 3 | 4 | 3 | 4 |
| 3 | 3 | 4 | 3 | 4 | 3 | 4 |
| 5 | 3 | 4 | 3 | 4 | 3 | 4 |
| 15 | 3 | 4 | 3 | 4 | 3 | 4 |
| 30 | 3 | 4 | 4 | 4 | 3 | 4 |
| 32 | 3 | 4 | 3 | 4 | 3 | 4 |

TABLE III

Modification Rating (Class) of 319 With 0.01% and 0.02% Sr Addition

| Time | 0.005% Ti .01% | | 0.022% Ti | | 0.2% Ti | |
|---|---|---|---|---|---|---|
| Min. | Sr | .02% Sr | .01% Sr | .02% Sr | .01% Sr | .02% Sr |
| 1 | 3 | 4 | 3 | 4 | 3 | 4 |
| 3 | 3 | 4 | 4 | 4 | 4 | 4 |
| 5 | 4 | 4 | 4 | 4 | 4 | 4 |
| 15 | 4 | 4 | 4 | 4 | 4 | 4 |
| 30 | 4 | 4 | 4 | 4 | 4 | 4 |
| 32 | 4 | 4 | 4 | 4 | 4 | 4 |

We claim:

1. An Al-Sr-B master alloy consisting essentially of, in weight percent, B from about 0.10% to about 10%, Sr from about 0.20% to about 20%, Si from about 0.2% to about 20%, and the balance Al plus impurities normally found in master alloys.

2. The master alloy of claim 1 wherein the composition ratio of Sr to B is in the range of about 1.35–10 to 1.

3. The master alloy of claim 2 wherein the composition ratio of Sr to B is about 2–4:1.

4. The master alloy of claim 1 wherein the Sr concentration is from about 5% to about 15%.

5. The master alloy of claim 3 wherein the B concentration is from about 2% to about 8%.

6. The master alloy of claim 1 wherein the Sr concentration is in the range of about 8–10% and B concentration is about 5%.

7. The master alloy of claim 1 wherein substantially all of the Sr and B in said master alloy is in the form of $SrB_6$.

8. The master alloy of claim 1 wherein said master alloy exhibits sufficient ductility to form a high quality rod product.

9. The master alloy of claim 1 wherein a single addition of said alloy to a bath of hypoeutectic Al-Si alloy containing residual transition elements of Ti, V or Hf in the range of about, in weight percent, 0.001% up to about 0.25%, will simultaneously grain refine the alloy and modify the morphology of the Al-Si eutectic phase.

10. The master alloy of claim 6 wherein a single addition of said master alloy to a bath of hypoeutectic Al-Si alloy containing residual transition elements of Ti, V or Hf in the range of about, in weight percent, 0.001% to about 0.25%, will simultaneously grain refine the alloy and modify the morphology of the eutectic phase.

11. A process for making the Al-Sr-B master alloy comprising the steps of:

melting Al to form a molten bath;

adding sufficient B to said molten bath at a temperature from about 1220° F. to 1500° F. so that said master alloy contains about 0.10%–10% B;

adding sufficient Sr to said molten bath at a temperature from about 1220° F. to 1500° F. so that said master alloy contains about 0.20%–20% Sr; and casting said molten alloy.

12. A process for making the Al-Sr-Si-B master alloy of claim 1 comprising the steps of:

melting Al to form a molten bath;

adding sufficient B to said molten bath at a temperature from about 1220° F. to 1500° F. so that said master alloy contains about 0.10%–10% B;

adding sufficient Sr and Si to said molten bath at a temperature from about 1220° F. to 1500° F. so that said master alloy contains about 0.20%–20% Sr and 0.20% to about 20% Si; and casting said molten alloy.

13. A method of grain refining and modifying hypoeutectic Al-Si alloys comprising the addition of the master alloy of claim 1 to a molten bath of said Al-Si alloy to produce a grain refined and modified hypoeutectic Al-Si alloy.

* * * * *